US005191677A

United States Patent [19]

Lautenschläger et al.

[11] Patent Number: 5,191,677

[45] Date of Patent: Mar. 9, 1993

[54] CABINET HINGE

[75] Inventors: Horst Lautenschläger, Reinheim; Gerhard W. Lautenschläger, Brensbach, both of Fed. Rep. of Germany

[73] Assignee: Karl Lautenschlager GmbH & Co. KG, Reinheim, Fed. Rep. of Germany

[21] Appl. No.: 758,745

[22] Filed: Sep. 12, 1991

[30] Foreign Application Priority Data

Oct. 4, 1990 [DE] Fed. Rep. of Germany ..... 4031305

[51] Int. Cl.[5] ..... E05D 7/10; E05D 11/00

[52] U.S. Cl. ..... 16/257; 16/251; 16/DIG. 43

[58] Field of Search ..... 16/257, 250, 251, DIG. 43, 16/379, 241

[56] References Cited

U.S. PATENT DOCUMENTS

| | | | |
|---|---|---|---|
| 4,509,229 | 4/1985 | Salice | 16/379 |
| 4,680,830 | 7/1987 | Rock et al. | 16/241 |
| 4,841,598 | 6/1989 | Grass | 16/257 |
| 4,976,006 | 12/1990 | Lautenschlager | 16/257 |
| 5,054,164 | 10/1991 | Blanco-Equilez | 16/DIG. 43 |

*Primary Examiner*—Lowell A. Larson
*Assistant Examiner*—Carmine Cuda

[57] ABSTRACT

The present invention relates to a hinge for hanging a door on the carcase of a piece of furniture having an open front which is narrowed by projecting face frame stiles. The supporting arm of the hinge can be snapped onto or removed from a mounting plate which can be fastened onto the edge of the frame stile.

18 Claims, 3 Drawing Sheets

CABINET HINGE

BACKGROUND OF THE INVENTION

The present invention relates to a hinge for hanging a door on the carcase of a piece of furniture, having a door-related part which can be fastened to the door and a carcase-related part which is coupled by a linkage mechanism to the door-related part and removably fastened on a mounting plate which can be fastened to the carcase and a supporting arm straddling the mounting plate with an inverted U-shaped cross section, which is releasably joined by a catch mechanism to the mounting plate and has in each bottom edge of its lateral flanges, in their front end portion nearer the door, open-mouthed, hook-like hanging notches which can be hooked on associated corner portions in the area of the mounting plate nearer the door, while at the carcase-interior end of the supporting arm remote from the door two resiliently flexible tongues each with a hook are formed, which in the intended joining position are in form-fitting engagement each with a notch at the carcase-interior end portion of the mounting plate, the hooks and the notches, however, being able to be brought out of engagement by contrary bending of the tongues together parallel to the supporting wall surface, and each tongue has a handle accessible in the locked position of the supporting arm on the mounting plate for exerting a pressure directed one against the other parallel to the supporting wall surface.

In the hinges thus configured (German Patent Disclosure Document 38 20 338) the supporting arm of the hinge can simply and quickly be snapped onto the mounting plate and unsnapped therefrom without the need for difficult manipulation with a screwdriver or other installation tool. By the use of two resilient tongues which have to be squeezed together in a plane at right angles to the direction of the removal of the supporting arm from the mounting plate in order to unsnap the supporting arm, any unintentional unsnapping is as good as impossible. On the other hand, one-handed operation of the handles by squeezing between two fingers of one hand and then swinging the supporting arm away with the same hand is possible without fumbling. In other words, the known hinge of simple construction combines simplicity of operation with great security against unintentional unsnapping of the supporting arm from the mounting plate. It is true that the known hinge is intended for use on cabinets in which the mounting plate holding the supporting arm of the hinge is fastened directly on the inside surface of the cabinet side-wall. That is, the mounting plate and the supporting arm to be snapped onto it are subject to virtually no limitation of their length.

These hinges, however, are not suitable for cabinets in which the front of the cabinet on which the doors are to be mounted is narrowed by a face frame around the doorway to less than the actual inside width of the cabinet. The doors whose inside surface lies against the outer surface of the stiles projecting from the carcase walls and forming the frame must then be hung on these stiles, and hinges of different configuration have been developed for this purpose. Modern link hinges of the kind used in cabinets without face frames cannot be used in the application here involved, because only the narrow edge of the stiles is available for holding the mounting plate, so that a conventional mounting plate and the corresponding supporting arm would protrude into the interior of the cabinet. This would result not only in a restriction of the lateral cabinet space but also in the danger that objects might catch on the projecting hinge parts when they are removed from the cabinet. The supporting arm and the mounting plate of a multiple-link hinge intended for cabinets with face frames must therefore be made as short and compact as possible. This, however, complicates the use of the catch mechanism of the known hinge described above, in which the resilient tongues are punched from the material of the supporting arm flanges and extend parallel to the surface of the mounting plate on the cabinet side wall, so that any shortening of the supporting arm and mounting plate is difficult to incorporate into the design.

Consequently the invention is addressed to the problem of creating a hinge for the above-described cabinets with face frames, whose supporting arm and mounting plate have the required small dimensions to avoid protruding substantially into the cabinet interior from the frame, but in which a catch mechanism is achieved that is comparable with the known hinge as regards simplicity and reliability of operation, and permits the simple and quick hanging and removal of doors from a cabinet.

THE INVENTION

Setting out from a hinge of the kind described above, this problem is solved in accordance with the invention by the fact that the resiliently flexible tongues are directed from the web of the supporting arm at right angles to the mounting surface of the mounting plate on the cabinet carcase and are provided with the catch means at their free ends. That is to say, the shortening of the supporting arm and hence of the mounting plate on which it catches is made possible by the fact that the resilient tongues no longer run parallel with the supporting arm but at right angles to the mounting surface of the mounting plate.

The handles are best in the form of sections projecting into the carcase interior from the longitudinal margin of the tongue within the carcase interior, such as for example lugs stamped integrally with the tongue.

The resilient tongues are best formed by strips of the supporting arm material itself cut free in the rear end portion of the supporting arm's flanges, although of course these tongues can be made separately from spring material, such as spring steel, and they can be fastened separately on the supporting arm.

To adapt it to the stated purpose, the mounting plate of the hinge according to the invention is preferably in the form of a thin wing plate of metal having wings which project on both sides beyond the installed supporting arm, and which can be fastened on the mounting surface of the cabinet carcase. In the area of the resilient tongues of the supporting arm, two tabs accommodating the supporting arm between them in the proper mounting position are bent away with their edges facing the supporting arm running at an angle to one another toward the mounting surface. The distance between the sloping edges is greater at the free ends of the tabs than the distance between the outer sides of the catch hooks, measured transversely of the supporting arm, when the resilient tongues are in the uncompressed state, and smaller than the said distance between the catch hooks at the transition to the wing plate. The sloping edges thus form lead-in ramps which are engaged by the catch hooks of the resilient tongues when the supporting arm is snapped onto the mounting plate and, as pressure on the rear end of the supporting arm continues, they are compressed with resilient flexing of the tongues until the catch position is reached in which the catch hooks are aligned with the catch notches and catch in the latter with partial retroflexing of the resilient tongues.

The catch notches are best formed in the transition from the ramp edges to the wing plate.

In order to align the supporting arm with the mounting plate, not only in the rear area between the upturned tabs but also at the front, provision is made in further development of the invention for the mounting plate to have in its front end area facing the door a projection reaching between the lateral wings of the installed supporting arm, whose lateral edges facing the wings run at an angle from the free end toward the wing plate, while the distance measured from the free end of the projection is smaller between the sloping edges and the distance between the two sloping edges measured in the area of transition to the wing plate is substantially equal to the distance between the flanges of the supporting arm.

In this case, too, the projection is best a tab stamped from the material of the wing plate and bent up therefrom.

The corner portions on which the hook-like slots of the supporting arm are hung are, in a preferred further development of the invention, formed laterally adjoining the projection.

In the area of the wing plate that is covered by the supporting arm when the latter is installed, at least one opening can be punched whose outer boundaries measured transversely of the supporting arm are at a distance apart corresponding to the measurement made across the outside surfaces of the supporting-arm flanges. The bottom margin of the supporting arm or of tabs projecting from this bottom margin can then enter into the opening or openings for additional lateral alignment and stabilization on the mounting plate.

The wing plate itself expediently has on its front margin facing the door at least one thin, upturned tab pointing away from the installed supporting arm, which when the wing plate is in the properly mounted position lies on the front of the associated carcase stiles.

The supporting arm of the hinge is, like the wing plate as well, preferably stamped from sheet metal.

In each of the two wings of the wing plate projecting laterally from the installed supporting arm, a slot running transversely of the supporting arm can be provided, which permits adjustment of the height of the wing plate and thus of the corresponding hinge as a whole, and thus, again, of the door.

The supporting arm itself can be made open at its inner end pointing away from the door, and then the open end can be closed off by an end wall disposed between the resilient tongues and made so as to be removable from the supporting arm. If the width of the portion of the end wall situated between the resilient tongues is substantially equal to the clear distance between the resilient tongues snap-fastened &o the mounting plate, this end wall serves simultaneously for security against unintentional unfastening, since the resilient tongues cannot be squeezed together until the end wall has been entirely removed from the inner end of the supporting arm.

To enable it to be fastened to the supporting arm, the end wall can be configured such that it will have on its upper margin facing away from the mounting plate a clip which can be pushed over the rear edge of the web of the supporting arm.

The end wall including the clip is then preferably injection molded in one piece from a thermoplastic.

SUMMARY OF THE DRAWINGS

The invention will be further explained in the following description of an embodiment in conjunction with the drawing wherein.

DESCRIPTION OF PREFERRED EMBODIMENTS

Figure 1:
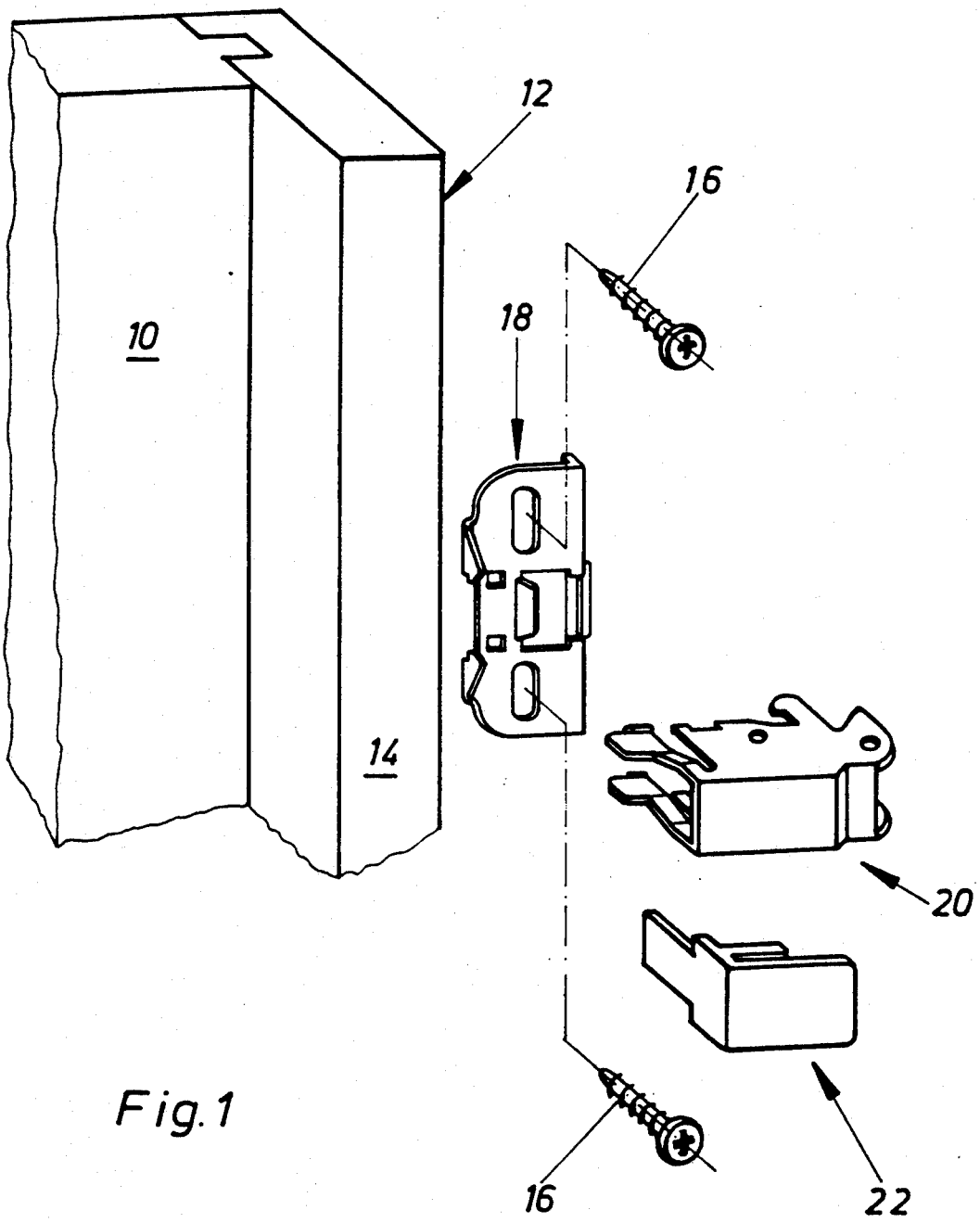
FIG. 1 is a perspective exploded view of a section of a cabinet side wall with an attached stile extending inward on whose edge the mounting plate of a hinge configured according to the invention is to be fastened, of which, in addition to the mounting plate and the screws for fastening it on the edge, only the supporting arm and back cover are shown, while the members of the hinge linkage and the door-related part are omitted, since these components can be configured in a known manner.

To represent the manner in which the hinge in accordance with the invention is attached to a corresponding piece of furniture, part of a cabinet side wall 10 and, attached to the front edge of the latter, part of a stile 12 of a frame defining the cabinet door opening, are drawn in perspective.

A door, not shown, is to be hung on the stile 12 such that its inner side will lie flat, in the closed position, on the front face (not seen in the drawing) of the stile 12. For this purpose the door is hung on the caracas of the cabinet with at least two linkage hinges which can be fastened on the stile 12, the drawing showing only the mounting plate 18 which is to be fastened directly on the edge 14 of the stile 12 with screws 16, and the supporting arm 20 which can be fastened removably to the mounting plate 18, plus a cover 22 closing the cabinet-interior end of the supporting arm.

Figure 2:
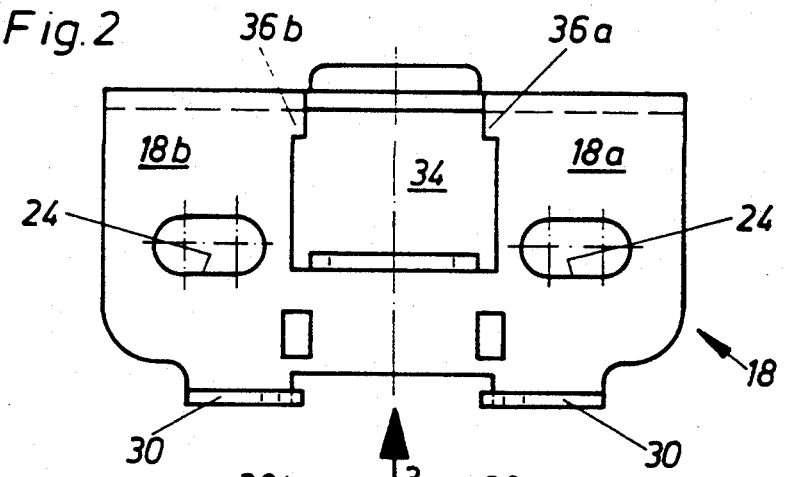
FIG. 2 is a plan view of the mounting plate of the hinge depicted in FIG. 1.
Figure 3:
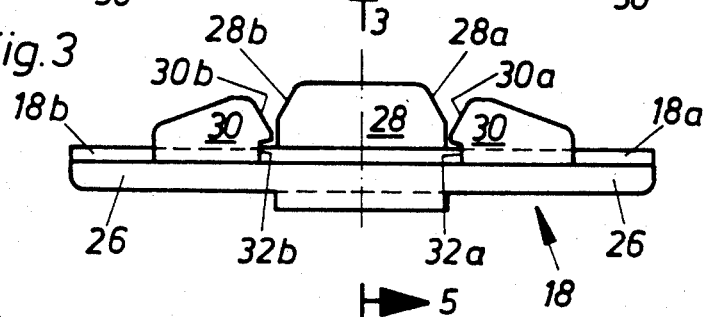
FIG. 3 is a view seen in the direction of arrow 3 in FIG. 2.

The mounting plate 18 depicted separately in FIGS. 2 and 3 is in the form of a thin wing plate stamped and formed from sheet metal, with two wings **18*a* and 18*b* projecting laterally from both sides of the superimposed supporting arm 20 of the hinge; into each wing there is punched a slot 24 through which the threaded shaft of the associated mounting screw 16 can be driven. Within their length the slots 24 permit the height adjustment of the mounting plate 18 and thus also of a door hung on the piece of furniture in question. On the front margins of the wings 18***a* and 18*b*, i.e., on the door side thereof, turned edges 26 are provided which come in contact with the front face of the stile 12 when the mounting plate 18 is properly installed thereon. Between the turned edges 26 a tab 28 is stamped from the central area of the mounting plate 18 and bent away in the direction opposite that of the turned edges 26. This tab 28 provided with sloping lateral edges 28*a*, 28*b*, reaches into the inside of the supporting arm 20 when the latter is fastened on the mounting plate 18, and orients it, on the door side, to its position on the mounting plate. On the back edges, i.e., those facing the cabinet interior, the wings 18*a* and 18*b* are each provided with a raised tab 30, and the tabs are spaced apart such that the supporting arm 20 will be held between them when it is in the properly fastened position on the mounting plate. To guide and center the supporting arm for its installation, the tabs 30 have edges 30*a* and 30*b* sloping toward one another from the free ends of the tab and toward the surface of the mounting plate. In the transition between the upturned tabs 30 and the actual mounting plate 18, notches 32*a* and 32*b* are punched into the tabs and cooperate with hooks of the supporting arm 20 which will be described hereinbelow in connection with FIGS. 4 to 6. From the area of the mounting plate 18 between the wings 18*a* and 18*b* a larger opening 34 is punched, which is enlarged at a slight distance from the front, door-side margin of the mounting plate 18 to a width corresponding to the outside width of the supporting arm 20, while it is slightly narrower in the area immediately adjoining the edge, so that inwardly reaching corner portions 36*a* and 36*b* are formed, which extend beyond the front edge of the mounting plate and into the turned edges 26.

The supporting arm 20, in turn, has a channel-shaped cross section, which in itself is common, i.e., it has a web 38 from whose lateral edges flanges 40 are bent at right angles and have in their front area reaching partially beyond the web 38 punched holes 42 and 44 in which the pivot pins are provided for mounting the links of the hinge (not shown) on the supporting arm. On each free edge of the flanges 40 a notch 48 formed by a hook-like projection 46 is provided, these notches being hung on the corner portions 36*a* and 36*b* of the mounting plate 18 when the supporting arm 20 is fastened in its proper position on the mounting plate 18.

In the rearward end portion of the supporting arm 20, resilient tongues 52 are formed by slots 50 punched from the flanges 40 and running from the free edge to the vicinity of the web 38. The lower, free ends of the resilient tongues 52 are bent to form outwardly pointing hooks 54*a* and 54*b* which are snapped into the notches 32*a* and 32*b* when the supporting arm is in its correctly fastened position. On the rearward margins of these resilient tongues 52, i.e., those facing the cabinet interior, projecting tabs 56 are integrally formed, which serve as finger grips with which the resilient tongues 52 can be squeezed together to such an extent that the hooks 54*a* and 54*b* come free of the notches 32*a* and 32*b* and the supporting arm can then be pivoted away by pulling it back from the mounting plate 18. The pivot axis is situated near the corner portions 36*a* and 36*b*. As soon as the rearward end of the supporting arm has been lifted above the upturned tabs 30*a* and 30*b*, the notches 48 of the supporting arm can then also be disengaged from the corner portions 36*a* and 36*b*. To install the supporting arm, the procedure is reversed, i.e., first the supporting arm 20, held at the appropriate angle, is hooked at the notch 48 on the corner portions 36*a* and 36*b* of the mounting plate 18, and then its rearward end is pressed down. The hooks 54*a* and 54*b* of the resilient tongues 52 then run onto the sloping edges 30*a* and 30*b* of the upturned tabs 30, and as pressure on the supporting arm between the tabs 30 increases the resilient tongues are forced toward one another until the hooks 54*a* and 54*b* snap into the notches 32*a* and 32*b* upon reaching the correct fastening position.

Figure 4:
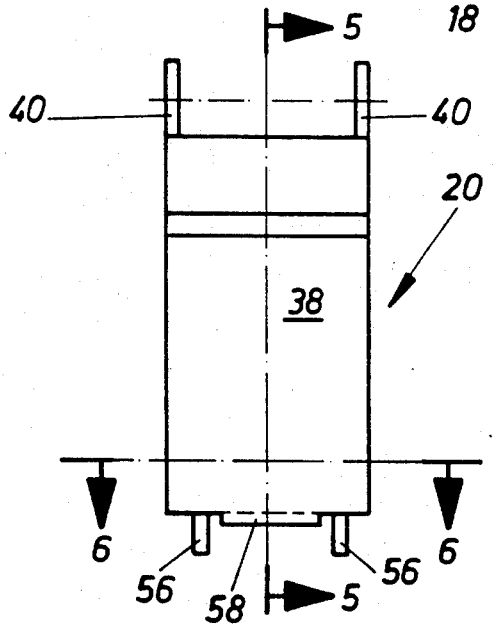
FIG. 4 is a plan view of the supporting arm of the hinge shown in FIG. 1, in a modified configuration of its cabinet-interior end, insofar as the covering is replaced by a section of material scored on and bent from the web of the supporting arm.
Figure 5:
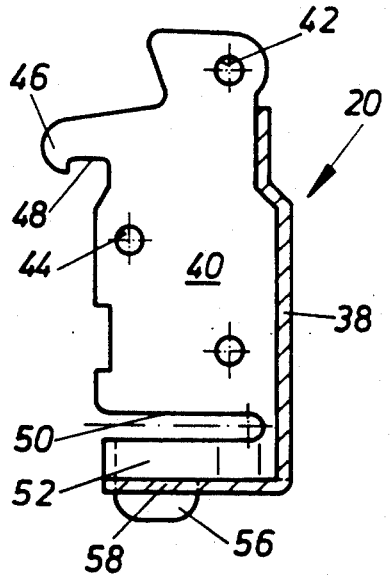
FIG. 5 is a sectional view seen in the direction of the arrows 5—5 in FIG. 4.
Figure 6:
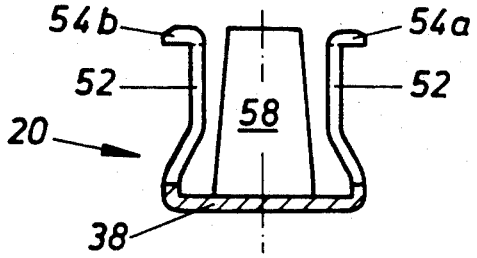
FIG. 6 is a sectional view seen in the direction of the arrows 6—6 in FIG. 4.

In the case of the supporting arm 20 depicted in FIGS. 4 to 6, the cabinet-interior end of the supporting arm is partially closed by a section of material 58 which is stamped from the web 38 and bent between the resilient tongues 52 and whose width is such that, when the resilient tongues 52 come in contact with its lateral edges, the hooks 54*a* and 54*b* have already come free of the notches 32*a* and 32*b*.

Figure 7:
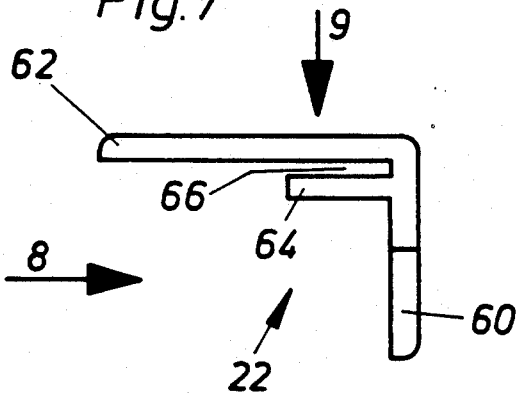
FIG. 7 is a side view of the cover shown in FIG. 1 for the cabinet-interior end of the supporting arm.
Figure 8:
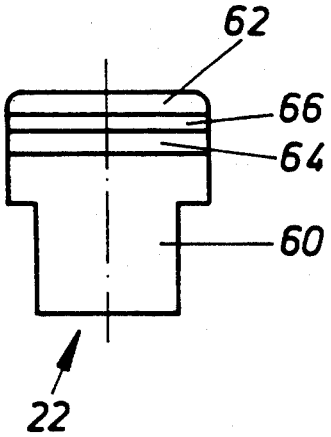
FIG. 8 is a view seen in the direction of arrow 8 in FIG. 7.
Figure 9:
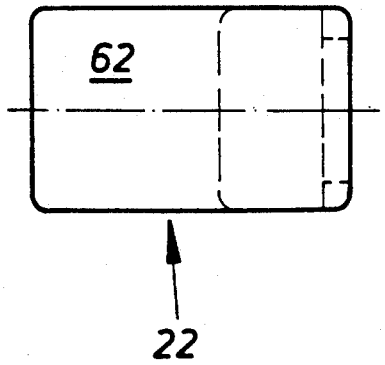
FIG. 9 is a view of the cover seen in the direction of arrow 9 in FIG. 7.

Finally, in FIGS. 7 to 9, as an alternative to the section of material 58 partially closing the inner end of the supporting arm 20, the cover 22, already mentioned in connection with FIG. 1, is shown in detail, which can be removably fastened on the then open inner end of the supporting arm 20. The cover 22, which is best made by injection molding from plastic, has a back end wall 60 whose width, at least in its lower portion lying between the resilient tongues, is approximately equal to the clear distance between the resilient tongues 52 when the supporting arm 20 is fastened on the mounting plate. When the cover 22 is in place the end wall 60 prevents the resilient tongues 52 from being squeezed together and thus constitutes an additional security against unintentional unfastening. The cover 22 is held by two parallel flat projections 62 and 64 extending at right angles from the upper margin of the end wall 60, which between them form a clip 66. The cover is fastened to the supporting arm 20, therefore, by pushing the clip 66 onto the supporting arm from the rear, free margin of the web 38, and then the flat projection 62 will lie on the top and the projection 64 on the bottom of the web.

We claim:

1. Hinge for hanging a door on the carcase of a piece of furniture, having a door-related part which can be fastened to the door and a carcase-related part which is coupled by a linkage mechanism to the door-related part and removably fastened on a mounting plate which can be fastened to the carcase and a supporting arm straddling the mounting plate with an inverted U-shaped cross-section, which is releasably joined by a catch mechanism to the mounting plate and has in each bottom edge of its lateral flanges, in their front end portion nearer the door, open-mouthed, hook-like hanging notches which can be hooked on associated corner portions in the area of the mounting plate nearer the door, while at the carcase-interior end of the supporting arm remote from the door two resiliently flexible tongues each with a hook are formed, which in the intended joining position are in form-fitting engagement each with a notch at the carcase-interior end portion of the mounting plate, the hooks and the notches being able to be brought out of engagement by contrary bending of the tongues together parallel to the supporting wall surface, and each tongue having a handle accessible in the locked position of the supporting arm on the mounting plate for exerting a pressure directed one against the other parallel to the supporting wall surface, said resiliently flexible tongues (52) being pointed at the mounting plate, beginning from the web (38) of the supporting arm (20) at right angles to the fastening surface of the mounting plate (18) on the cabinet carcase, and being provided at their free ends with the hooks (54*a*; 54*b*), and said mounting plate (18) having in its front end portion facing the door a projection (28) reaching between the lateral flanges (40) of the installed supporting arm, whose lateral edges (28*a*; 28*b*) facing the flanges run at an angle from the free end toward the mounting plate, the distance between the sloping edges (28*a*; 28*b*) measured at the free end of the projection (28) being less than, and the distance of the two sloping edges from one another, measured in the area of transition to the mounting plate, being substantially equal to the clear distance between the lateral flanges (40) of the supporting arm.

2. Hinge according to claim 1, wherein the handles are projections (56) extending from the carcase-interior longitudinal margin of the tongues (52) into the carcase interior.

3. Hinge according to claim 2, wherein the projections (56) are tabs cut integrally on the tongues (52).

4. Hinge according to any one of claims 1, 2 or 3 wherein the tongues (52) are formed by strips of the supporting arm material cut free from the supporting-arm flanges (40) in the rearward end portion.

5. Hinge according to any one of claims 1, 2 or 3 wherein that the mounting plate (18) is in the form of a thin wing plate of metal having wing projections (18*a*; 18*b*) projecting on both sides beyond the installed supporting arm (20), which can be fastened on the fastening surface of the cabinet carcase, at which, in the vicinity of the resilient tongues (52) of the supporting arm (20), two tabs (30) are raised which accommodate the supporting arm between them in the intended fastening position, whose edges (30*a*; 30*b*) facing the supporting arm run sloping toward one another from the free tab ends toward the fastening surface, the clear distance between the sloping edges (30*a*; 30*b*) being greater at the free tab ends than the external distance between the hooks (54*a*; 54*b*) measured transversely of the supporting arm in the unsqueezed state of the resilient tongues (52), and in the transition to the wing plate is smaller than the said distance between the hooks (54*a*; 54*b*).

6. Hinge according to claim 5, wherein the notches (32*a*; 32*b*) are formed in the transitional reach of the sloping edges (30*a*; 30*b*) to the wing plate.

7. Hinge according to claim 5, wherein at least one opening (34) is punched in the portion of the wing plate covered by the supporting arm (20) when it is installed, and its outer defining edges measured transversely of the supporting arm (20) are at a distance from one another corresponding to the dimension measured across the outside surfaces of the supporting arm flanges (40).

8. Hinge according to claim 5, wherein the wing plate has its front margin facing the door at least one thin, strip-like turned edge (26) directed away from the installed supporting arm (20).

9. Hinge according to claim 5, wherein the wing plate (18) is a piece stamped and embossed from sheet metal.

10. Hinge according to claim 5, wherein, in each of the two wing projections (18*a*; 18*b*) projecting laterally from the supporting arm (20) when the supporting arm (20), a slot (24) running transversely of the supporting arm (20) is provided.

11. Hinge according to claim 1, wherein the projection (28) is a tab punched from the material of the wing plate and bent upward.

12. Hinge according to claim 1, wherein the corner portions (36*a*; 36*b*) of the mounting plate (18) associated with the hook-like hanging notches (48) of the supporting arm (20) are each formed laterally adjoining the projection (28).

13. Hinge according to claim 1, wherein the supporting arm (20) is a piece stamped and embossed from sheet metal.

14. Hinge according to claim 1, wherein the supporting arm (20) is open at its inner end facing away from the door, and that the open end is closed with an end wall (60) disposed between the resilient tongues (52) and made removable from the supporting arm (20).

15. Hinge according to claim 14, wherein the end wall (60) has at its upper margin facing away from the mounting plate a clip (66) which can be pushed over the rearward edge, facing away from the door, of the web (38) of the supporting arm (20).

16. Hinge according to claim 15, wherein the end wall (60) is a piece injection-molded from plastic.

17. Hinge according to claim 14, wherein the width of the portion of the end wall (60) lying between the resilient tongues (52) is substantially equal to the clear distance between the resilient tongues snapped onto the mounting plate.

18. Hinge according to any one of claims 14 or 17, wherein the end wall (60) is a piece injection-molded from plastic.

* * * * *